US011801408B2

(12) United States Patent
Carozzani et al.

(10) Patent No.: US 11,801,408 B2
(45) Date of Patent: Oct. 31, 2023

(54) GYMNASTICS BEAM HAVING AN INTERCHANGEABLE UPPER PART

(71) Applicant: GYMNOVA, Marseilles (FR)

(72) Inventors: Joris Carozzani, Lyons (FR); Jérôme Bourquard, Besancon (FR)

(73) Assignee: GYMNOVA, Marseilles (FR)

( * ) Notice: Subject to any disclaimer, the term of this patent is extended or adjusted under 35 U.S.C. 154(b) by 39 days.

(21) Appl. No.: 17/434,959

(22) PCT Filed: Feb. 24, 2020

(86) PCT No.: PCT/FR2020/050342
§ 371 (c)(1),
(2) Date: Aug. 30, 2021

(87) PCT Pub. No.: WO2020/178501
PCT Pub. Date: Sep. 10, 2020

(65) Prior Publication Data

US 2022/0134159 A1 May 5, 2022

(30) Foreign Application Priority Data

Mar. 1, 2019 (FR) ..... 1902119

(51) Int. Cl.
*A63B 4/00* (2006.01)

(52) U.S. Cl.
CPC ..... *A63B 4/00* (2013.01)

(58) Field of Classification Search
CPC ..... A63B 4/00; A63B 2210/50
See application file for complete search history.

(56) References Cited

U.S. PATENT DOCUMENTS 1,041,701 A * 10/1912 Titornley ..... A63B 5/12 482/25
6,383,118 B1 * 5/2002 Nestoiter ..... A63B 4/00 482/23

(Continued)

FOREIGN PATENT DOCUMENTS

DE 3330593 3/1985
DE 3330593 A1 * 3/1985

(Continued)

OTHER PUBLICATIONS

International Search Report for PCT/FR2020/050342, dated Jul. 9, 2020, 5 pages.

(Continued)

*Primary Examiner* — Nyca T Nguyen
(74) *Attorney, Agent, or Firm* — NIXON & VANDERHYE

(57) ABSTRACT

Disclosed is a gymnastics beam including a rigid profile, a layer of a flexible material arranged on an upper surface of the profile, and a coating covering the layer of flexible material. The beam included a lower part including a lower part of the profile that bears against an upper part including an upper part of the profile, and a connector to secure or separate the lower part and the upper part. This permits rapid renovation of the beam by changing only the upper part. Moreover, characteristics of the beam such as the width and the hardness of its bearing surface can be adapted by changing the upper part or, where relevant, segments of the upper part, such that the beam can be modulated. Also disclosed is an assembly including multiple upper parts.

14 Claims, 5 Drawing Sheets

(56) References Cited

U.S. PATENT DOCUMENTS

| | | | | |
|---|---|---|---|---|
| 6,517,466 | B2 * | 2/2003 | Eyman, Jr. | A63B 4/00 482/25 |
| 2002/0177508 | A1 * | 11/2002 | Eyman, Jr. | A63B 4/00 482/23 |
| 2009/0093343 | A1 * | 4/2009 | Gallus | A63B 4/00 482/34 |
| 2019/0022464 | A1 * | 1/2019 | Brieu | A63B 26/00 |
| 2019/0126085 | A1 * | 5/2019 | Venhuizen | A63B 4/00 |

FOREIGN PATENT DOCUMENTS

| | | | | |
|---|---|---|---|---|
| EP | 3476438 | A1 * | 5/2019 | A63B 4/00 |
| FR | 2587390 | A1 * | 3/1987 | |
| FR | 2719488 | | 11/1995 | |
| FR | 3093290 | A1 * | 9/2020 | A63B 4/00 |
| JP | S5089445 | | 7/1975 | |
| JP | S6236755 | | 3/1987 | |
| WO | 02/094385 | | 11/2002 | |
| WO | WO-2018115583 | A1 * | 6/2018 | A63B 4/00 |

OTHER PUBLICATIONS

Written Opinion of the ISA for PCT/FR2020/050342, dated Jul. 9, 2020, 5 pages.

* cited by examiner

GYMNASTICS BEAM HAVING AN INTERCHANGEABLE UPPER PART

This application is the U.S. national phase of International Application No. PCT/FR2020/050342 filed 24 Feb. 2020, which designated the U.S. and claims priority to FR Patent Application No. 1902119 filed 1 Mar. 2019, the entire contents of each of which are hereby incorporated by reference.

BACKGROUND OF THE INVENTION

Field of the Invention

The present invention concerns the technical field of artistic gymnastics equipment, also called apparatuses, and more particularly the field of balance beams.

Description of the Related Art

A balance beam is an apparatus used in feminine artistic gymnastics. It is an elongate rectangular beam raised relative to the ground by a leg or support at each of its ends.

A balance beam is commonly produced by an elongate member of specific cross-section of aluminum or of any other equivalent material having similar mechanical properties and good durability, covered with a covering for example of PVC (polyvinyl chloride), leather, imitation suede, artificial leather or other appropriate non-slippery material.

The geometry and dimensions of a balance beam are set by standards, for example the norms of the International Federation of Gymnastics which are referred to as "FIG" norms. For example, a balance beam must, in competition, have a length of five meters and a width of ten centimeters on its upper surface (bearing surface) on which the gymnasts perform. The standards also require characteristics regarding the rigidity of the balance beam, in particular its resistance to bending under load.

The FIG norms provide that the upper surface must have properties enabling shocks to be absorbed and to protect the joints of the gymnasts' limbs. It must furthermore be elastic to support jumps.

Thus, balance beams must, at least in the context of competitions, meet criteria, in terms of dimensions, impact force, deflection or sinking-in of the surface on impact, and in terms of rebound. The impact force must be limited to protect the gymnasts' joints. Rebound, which is expressed as the energy returned, must be within a certain range so as to enable the reception of the gymnasts while enabling the execution of a sequence of figures requiring a certain rebound. However, during training, these constraints do not have to be complied with. It is then possible, or even advantageous, to use for example a balance beam of which the surface is more flexible and less liable to cause injury for the gymnast's joints. Furthermore, a gymnast of little experience may wish to train on a balance beam of greater width than the width imposed in competition. Conversely, a gymnast may wish to train on a balance beam of smaller width than that imposed by the standards, for example in order that, once in competition, her exercise on the balance beam will be easier to perform than in training.

This requires the use of several balance beams, which is costly and requires a large amount of storage space.

Furthermore, the covering of a balance beam is susceptible to wear. As the covering is generally bonded, stapled or firmly attached to the balance beam, its replacement is long, complex and costly. In practice, the user is obliged to send the entire balance beam to a workshop for its renovation. The renovation covers currently available do not necessarily constitute a perfect solution to this problem, in particular because they require careful laying to obtain a satisfactory result and avoid them sliding on the renovated balance beam.

SUMMARY OF THE INVENTION

The invention relates to a device which is directed to solving some or all of the aforementioned problems.

In particular, the invention relates to a gymnastics balance beam comprising a rigid elongate member of specific cross-section, a layer of a flexible material disposed on an upper surface of said elongate member of specific cross-section, and a covering which covers said layer of flexible material. The balance beam comprises a bottom part comprising a lower part of the elongate member of specific cross-section and a top part comprising an upper part of the elongate member of specific cross-section.

The upper part of the elongate member of specific cross-section is laid in bearing relationship on the lower part of the elongate member of specific cross-section. The upper part of the elongate member of specific cross-section is rigidly fastened to the lower part of the elongate member of specific cross-section by connecting means configured to attach or detach the bottom part and the top part.

As the top part may be fastened onto the bottom part or separated according to need, the balance beam thus formed has multiple advantages. Bearing by the top part on the bottom part combined with a rigid connection between these parts avoids any relative movement between these parts on use of the balance beam. It is possible to renovate it easily and quickly, without sending it to a workshop, by simply replacing the top part.

It is also possible to change the characteristics of the balance beam by adopting a top part having the desired properties. For example, in a range of top parts, it is possible to choose a top part conferring upon the balance beam a width equal to, greater than or less than the width imposed by the FIG norms. Similarly, it is possible to choose the desired hardness, from a range of top parts configured to be mounted on the bottom part of the balance beam.

In such a balance beam, a lower face of the upper part of the elongate member of specific cross-section may bear on an upper face of the lower part of the elongate member of specific cross-section with which it has complementarity of shape.

According to one embodiment, the connecting means comprise a shaft passing vertically through the lower part of the elongate member of specific cross-section, the shaft comprising a head at one end, the connecting means comprising an actuating mechanism making it possible to raise or lower the shaft in its direction of extension, such that in a lowered position of the shaft, the head presses upon the upper part of the elongate member of specific cross-section which attaches it to the top part of the elongate member of specific cross-section and holds it in position. The actuating mechanism may comprise a lever of quick release type.

The upper part may comprise a longitudinal groove of a width enabling the passage of the shaft but not enabling the passage of the head of said shaft, such that in a raised position of the shaft the upper part may be translationally moved longitudinally over the lower part of the elongate member of specific cross-section.

According to one embodiment, the connecting means comprise a threaded member passing through the lower part of the elongate member of specific cross-section, said threaded member being engaged in a tapped member rigidly connected to the upper part or formed within the latter.

The invention also relates to an assembly comprising a balance beam and at least one additional top part, said additional top part differing from the top part of the balance beam by the width of its upper surface, and/or by the hardness of the layer of flexible material that is disposed thereon.

Such an assembly may comprise at least two top parts of which the upper surfaces have two different widths from among: ten centimeters, eight centimeters, and twelve centimeters, fifteen centimeters, and twenty centimeters.

It may comprise at least two top parts on the upper surfaces of which are disposed layers of flexible material, said layers of flexible material being of different hardness.

The invention also relates to a balance beam as already described, in which the top part is constituted by several distinct sections, it being possible for said sections to differ from each other by their width and/or by the hardness of their layer of flexible material.

The invention also relates to a method of renovating a balance beam, comprising the successive steps of:

providing a balance beam to renovate as described above;

providing a new top part, detaching the top part of the balance beam to renovate from the bottom part of said balance beam to renovate, and removing said top part of the balance beam to renovate, laying the new top part on the bottom part of the balance beam to renovate, and attaching the new specific cross-section elongate member top part and the bottom part of the balance beam to renovate, by the connecting means.

Still other particularities and advantages of the invention will appear in the following description.

BRIEF DESCRIPTION OF THE DRAWINGS

In the accompanying drawings, given by way of non-limiting example.

DESCRIPTION OF THE PREFERRED EMBODIMENTS

Figure 1:
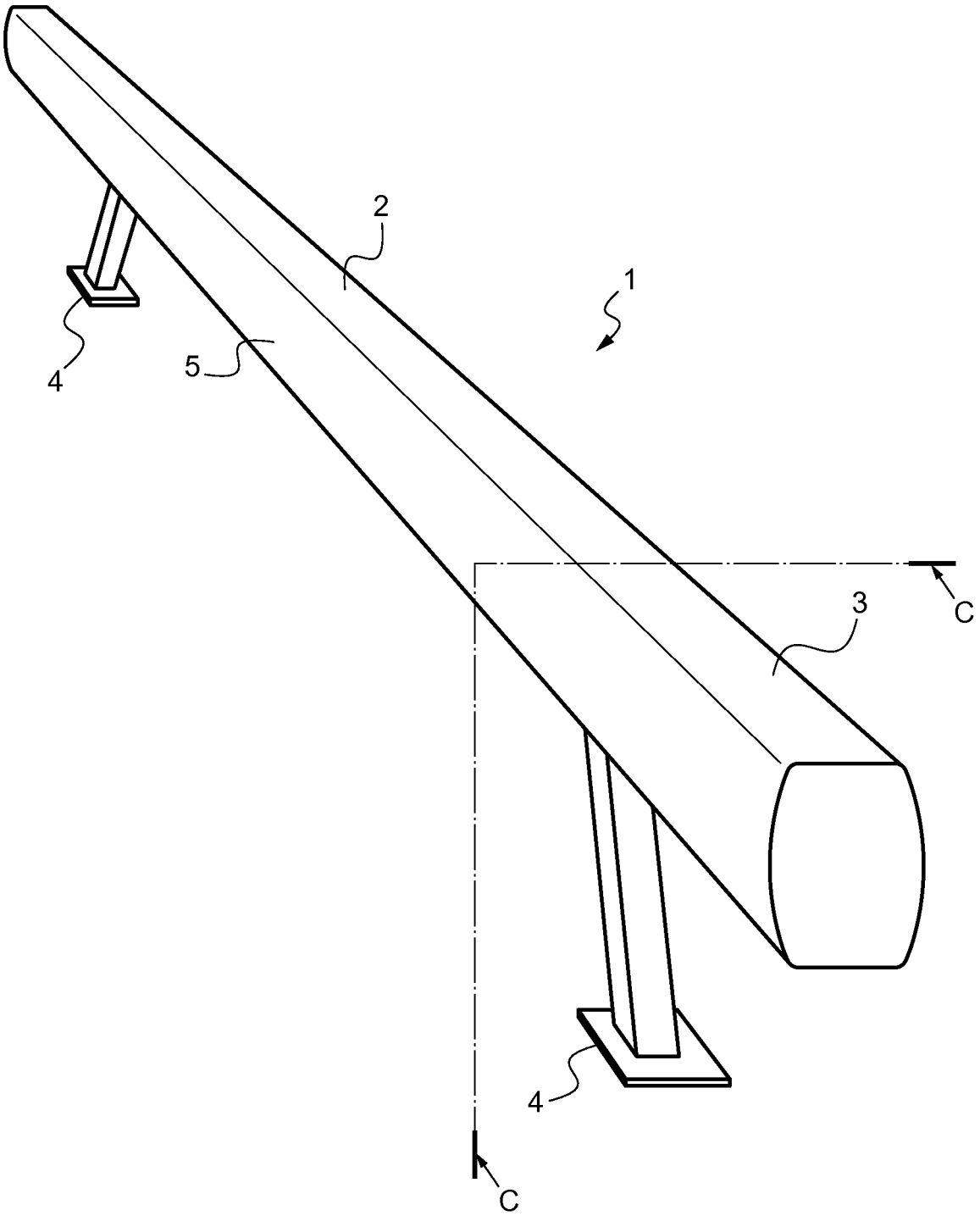
FIG. 1 presents in a three-dimensional diagrammatic view a gymnastics balance beam in accordance with the state of the art.

FIG. 1 presents a gymnastics balance beam 1. A gymnastics balance beam 1 is an apparatus comprising an actual beam 2, that is to say an elongate horizontal support, which comprises an upper surface 3 on which a gymnast may perform.

According to the standards of the International Federation of Gymnastics (referred to as the FIG norms), the balance beam 2 has a length of five meters, and its upper surface 21 has a width of ten centimeters. The beam 2 has a cross-section having a maximum width of thirteen centimeters. The beam 2 is supported by two legs forming beam supports 4. These beam supports 4 maintain the beam 2 in a stable position even when it is used by a gymnast. They may enable adjustment in height or even, if so arranged, be elastically adjustable to give the gymnasts several positions of rigidity.

The beam 2 may be produced from any appropriate material such as wood or aluminum. The beam 2 is finished by a beam end piece 22 which is advantageously flexible.

The beam 2 is covered with a covering 5, taking for example the form of a sleeve. Without being slippery, the covering of the upper surface of the beam must enable effort-free movements and rotations. In particular, the material of the covering must not cause skin burns. Thus, the covering employed may be constituted by, or have, an outside layer of leather, artificial leather, PVC, imitation suede or any other appropriate natural or synthetic material.

The covering 5 is generally bonded, stapled and/or attached by any other means to the beam. This avoids any slipping of the covering 4 on the beam 2 during the performance of a gymnast on the beam.

Figure 2:
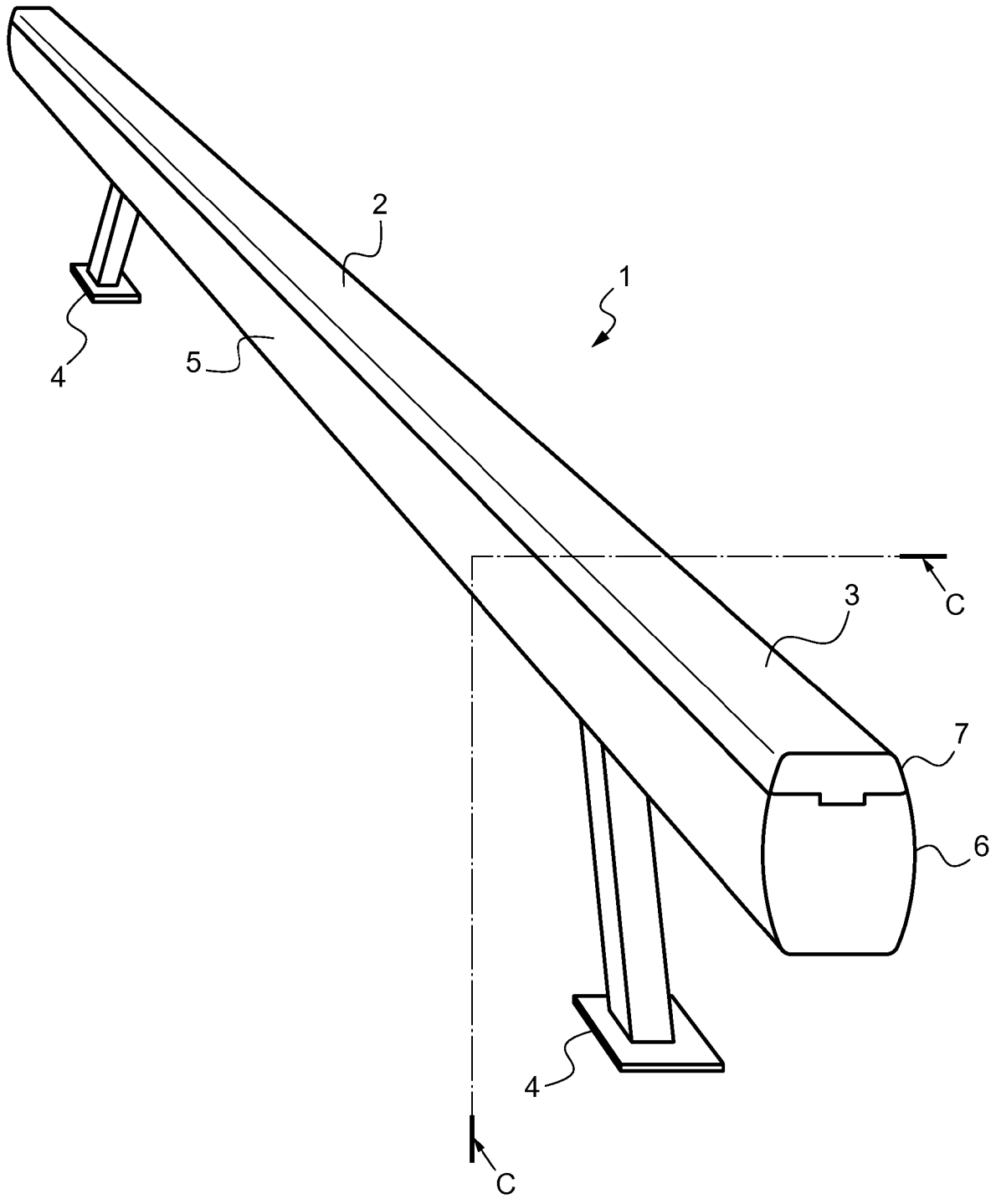
FIG. 2 shows, in a three-dimensional diagrammatic view similar to that of FIG. 1, a balance beam in accordance with an embodiment of the invention.

FIG. 2 shows, in a general view similar to that of FIG. 1, a gymnastics balance beam 1 in accordance with an example embodiment of the invention. The beam 2 of this apparatus is essentially distinguished from a beam of an apparatus produced according to the state of the art in that it consists of two parts, i.e. a bottom part 6 and an upper part 7. The bottom part forms the main mechanical structure of the gymnastics balance beam, to which feet or some other mounting are attached. The top part forms the surface on which performs the gymnast. In the interest of simplicity, and to better illustrate the demarcation between the bottom part 6 and the top part 7, in FIG. 2 the optional beam end fitting which can be fitted to each end of the beam has been omitted.

The invention will be better understood on seeing FIGS. 3 to 6 which present a cross-section view, on the section plane C-C, for a beam in accordance with diverse variants and diverse embodiments of the invention.

Figure 3:
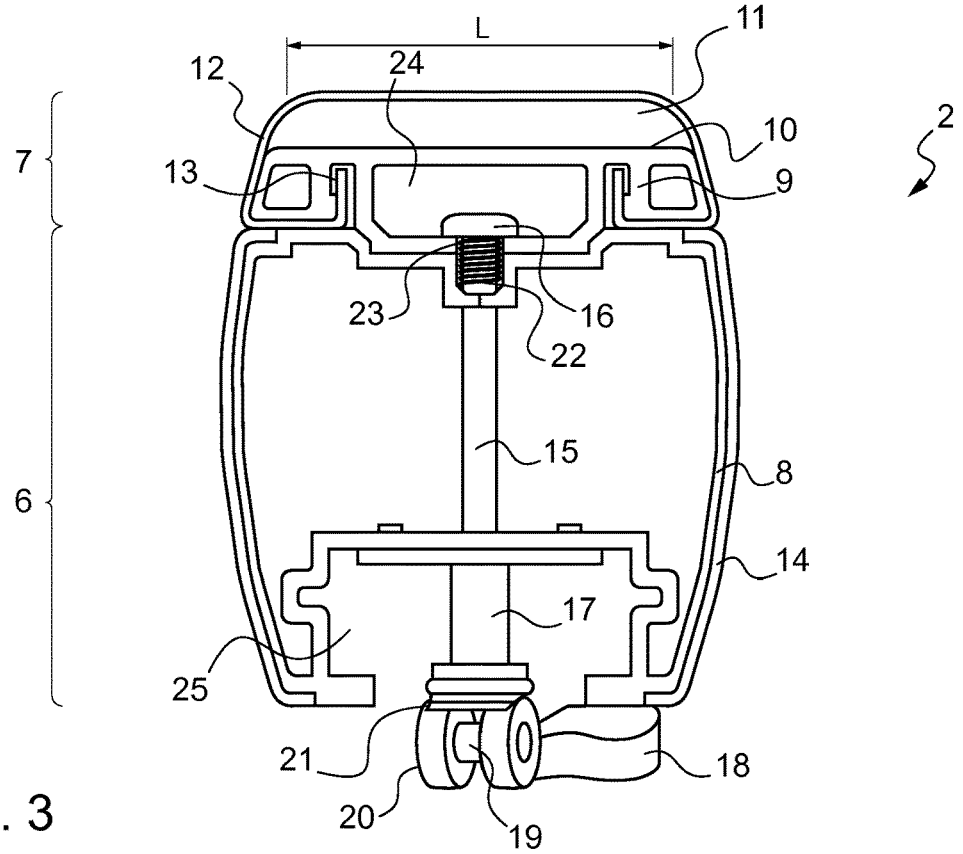
FIG. 3 show a gymnastics balance beam in accordance with an embodiment of the invention, in a cross-section view.

FIG. 3 shows a view on the section plane C-C shown in FIGS. 1 and 2, of a gymnastics balance beam in accordance with an embodiment of the invention. The balance beam 2 shown in FIG. 3 meets the requirements of the FIG norms. In particular, its bearing surface that bears the gymnast has a width L of 10 cm.

Just like a balance beam produced according to the state of the art, the balance beam 2 comprises an elongate member of specific cross-section forming the main mechanical structure of the beam. According to the invention, the beam 2 is formed in two parts, i.e. a bottom part 6 and a top part 7. In particular, the elongate member of specific cross-section of the beam itself comprises a lower part 8 and an upper part 9. The lower part 8 of the elongate member of specific cross-section and an upper part 9 of the elongate member of specific cross-section may be formed of metal. One of them and/or the other may in particular be formed from aluminum or from aluminum alloy.

The upper part 9 is laid in bearing relationship on the lower part 8, and is rigidly fastened thereto by appropriate connecting means. The beam thus has the same cohesion, after assembly, as a conventional one-piece beam. In order to ensure maximum surface area for bearing between the lower part 8 of the elongate member of specific cross-section and the upper part 9 of the elongate member of specific cross-section, the parts in contact between the lower part 8 of the elongate member of specific cross-section and the upper part 9 of the elongate member of specific cross-section are of complementary shape. This complementarity of shape can also ensure the proper centering of the upper part 9 of the elongate member of specific cross-section on the lower part 8 of the elongate member of specific cross-section. In the example shown here, the lower part 8 of the elongate member of specific cross-section thus forms a longitudinal rail (along the direction of extension of the beam 2) in which a corresponding part of the upper part 9 of the elongate member of specific cross-section comes to be accommodated.

The upper part 9 of the elongate member of specific cross-section comprises a flat upper surface 10 on which is disposed a layer of a flexible material 11. The layer of flexible material makes it possible to damp a portion of the impacts, is sufficiently elastic not to cause injury, and to provide sufficient rebound. It is however sufficiently hard to ensure the security of the bearing contacts, or stability.

The layer of flexible material 11 is attached, for example bonded, to the upper surface 11 of the elongate member of specific cross-section (here located on the upper part 9 of the elongate member of specific cross-section).

The beam has a covering 12 on its outside surface. The coating 12 may in particular be of PVC (polyvinyl chloride), leather, imitation suede, synthetic leather or other non-slippery material suitable for the performance of the gymnast. The covering 12 thus covers the layer of flexible material 11, as well as the lateral zones of the upper part 9 of the elongate member of specific cross-section. In order to be properly tensioned and attached, the covering 12 may be folded in and fixed in two longitudinal channels 13 located under the upper part 9 of the elongate member of specific cross-section.

The lower part 8 of the elongate member of specific cross-section is also covered, on its lateral faces, by a lower covering 14. The lower covering 14 may be of the same nature as the covering 12. The lower covering 14 may thus for example be of PVC (polyvinyl chloride), leather, imitation suede or of synthetic leather. Since the lower covering does not have a functional role or has a limited functional role when a gymnast is performing on the balance beam, it may be of a different nature from the covering 12. For example, the lower covering 14 may be formed from a shell (or in practice from two half-shells) of plastic.

Connecting means are provided in order to reliably fasten the top part 7 of the beam to the bottom part 6. In practice, the upper part 9 of the elongate member of specific cross-section is fastened to the lower part 8 of the elongate member of specific cross-section.

The fastening means may be released, so as to enable the separation of the upper part 7 of the beam relative to the lower part 6.

Figure 4:
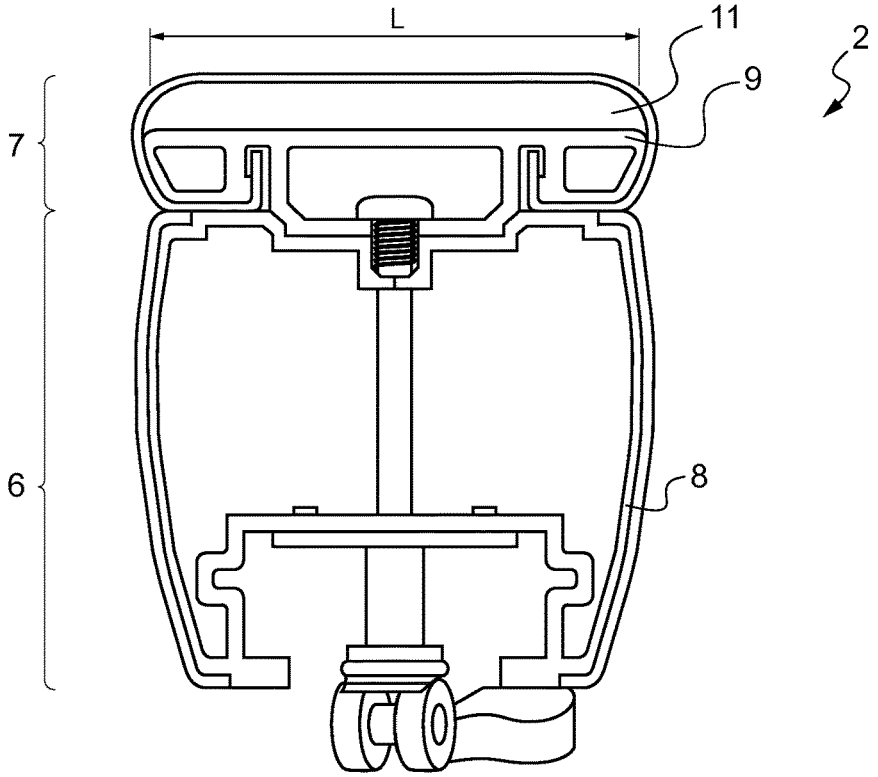
FIG. 4 show a gymnastics balance beam in accordance with a variant of the embodiment of FIG. 3, in a cross-section view.

In the embodiment of FIG. 4, the fastening means comprise a quick fastener system which passes vertically through the lower part 8 of the beam (the bearing surface of the beam and the upper surface 11 of the elongate member of specific cross-section being assumed horizontal). The fastening means come out at the top part of the lower part 8 of the elongate member of specific cross-section and are in engagement with the upper part 9 of the elongate member of specific cross-section. More particularly, the connecting means comprise a vertical shaft 15. The shaft 15 comprises a head 16 at one of its ends, i.e. its end which extends beyond the top part of the lower part 8 of the elongate member of specific cross-section. The shaft 15 may have a circular cross-section. Other cross-sections may be envisioned.

The bearing head 6 has a widened cross-section compared with that of the shaft 15. The shaft 15 is guided in translational movement within a sleeve 17. In the bottom part, the shaft is connected to a lever 18 is of the quick release type. This type of device, known in the field of mechanical connections for example in the field of cycling, comprises a lever which is rotationally linked around a pivotal shaft 19 in relation to the shaft 15. The lever 18 comprises around its pivotal shaft 19 a cam-forming surface 20. The cam-forming surface 20 may be substantially circular, the center of this circular surface being offset from the pivotal shaft 19. The cam-forming surface 20 is maintained in bearing relationship on a flange 21 located at the end of the sleeve 16 under the effect of a return spring 22. It follows that pivoting of the lever 18 causes translational movement of the shaft 15 within the sleeve 16. The shaft 15 may thus adopt at least one raised position and at least one lowered position.

In the embodiment illustrated, the upper part 9 of the elongate member of specific cross-section comprises a longitudinal groove 23. The longitudinal groove 23 extends in the bottom part of the upper part 9 of the elongate member of specific cross-section, for example in the middle thereof. The longitudinal groove 23 is open to a cavity 24 of the upper part 9 of the elongate member of specific cross-section. The longitudinal groove23 has a width enabling the passage of the shaft 15, but not enabling the passage of its head 16.

The longitudinal groove 23 may extend over the whole length of the upper part 9 of the elongate member of specific cross-section or over only part of its length. If the longitudinal groove 23 extends over the whole length of the upper part 9 of the elongate member of specific cross-section, the upper part 9 of the elongate member of specific cross-section may be slid over the lower part 8 of the elongate member of specific cross-section, from one of its ends, the shaft 15 being in raised position, the head 16 being inserted into the cavity 24. If the longitudinal groove 23 is of smaller size, it has widened zones enabling the passage, vertically, of the head 16. The upper part 9 of the elongate member of specific cross-section is put in place on the lower part 8 of the elongate member of specific cross-section in a longitudinal position in which the head 16 is in register with the widened zones of the groove, which enables the head 16 to be inserted into the cavity 24, then, with the shaft 15 in raised position, the upper part 9 of the elongate member of specific cross-section is translated longitudinally into its final position in which the head 16 is opposite a non-widened zone of the longitudinal groove, such that the head 16 cannot escape by said groove.

Once the upper part of the elongate member of specific cross-section has been brought into a proper longitudinal position, typically in which the upper part 9 of the elongate member of specific cross-section is exactly superposed on the lower part 8 of the elongate member of specific cross-section, the lever 18 is actuated to bring the shaft 15 and its head 16 into lowered position.

In the lowered position, shown in FIG. 3, the head 16 of the shaft 15 bears on a surface of the cavity 24, which presses the upper part 9 of the elongate member of specific cross-section onto the lower part 8 of the elongate member of specific cross-section and prevents them from moving relative to each other. The withdrawal of the upper part 9 of the elongate member of specific cross-section from the lower part 8 of the elongate member of specific cross-section and thus from the rest of the beam 2 is carried out in the opposite manner. Thus, to withdraw the upper part 9 of the elongate member of specific cross-section the lever 18 is actuated to bring the shaft 15 into raised position. The pressure between the parts is released, which enables the upper part 9 of the elongate member of specific cross-section to be translated over the lower part 8 of the elongate member of specific cross-section. The upper part 9 (and thus the top part 7 of the beam) may be separated, depending on the configuration of the beam considered, either by continuing that translation to the end of the beam 2, or by bringing the head 16 opposite a widened zone of the groove 23 enabling the upper part 9 of the elongate member of specific cross-section to be extracted vertically.

In the example shown, a major part of the connecting means is included in a lower cavity 25 of the beam 2.

The withdrawal of the upper part 9 of the elongate member of specific cross-section and the putting in place of a new upper part 9 of the identical elongate member of specific cross-section enable easy renovation of the beam 2.

In a cross-section view similar to that of FIG. 3, FIG. 4 shows a beam according to a variant of the embodiment of FIG. 3. The beam 2 shown in FIG. 4 is identical to that of FIG. 3 as regards its bottom part 6 and the connecting means employed. Nevertheless, the upper part 9 of the elongate member of specific cross-section has a different cross-section, and in particular has an upper surface 10 wider than that of FIG. 3. On that upper surface 10 there is deposited a layer of flexible material 11 also wider, leading to a bearing surface of 12 cm width L. Such a width is not in accordance with the FIG norms, but enables a gymnast with little experience to tackle certain exercises on the balance beam more easily. It more generally enables gymnasts to familiarize themselves more easily with certain figures which they have difficulty in achieving on a beam of standard dimensions.

Figure 5:
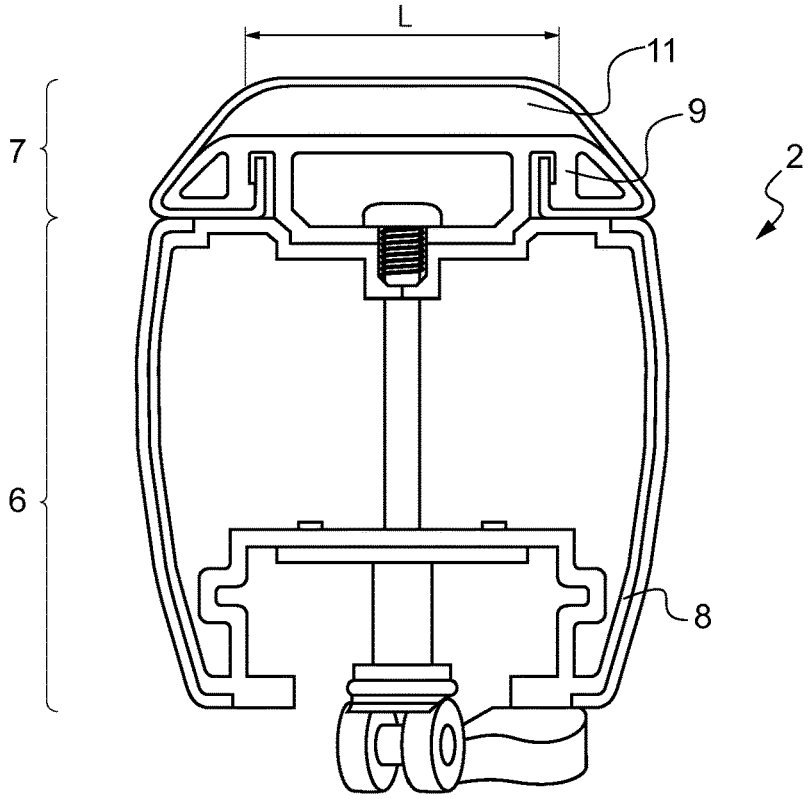
FIG. 5 show a gymnastics balance beam in accordance with a variant of the embodiment of FIGS. 3 and 4, in a cross-section view.

In a cross-section view similar to that of FIG. 3, FIG. 5 shows a beam according to a variant of the embodiment of FIG. 3. Just like the beam of FIG. 4, the beam 2 of FIG. 5 is identical to that of FIG. 3 with regard to its bottom part 6 and the connecting means implemented. Nevertheless, the upper part 9 of the elongate member of specific cross-section has a different cross-section, and in particular has an upper surface 10 narrower than that of FIG. 3. On that upper surface 10 there is deposited a layer of flexible material 11 also narrower, leading to a bearing surface of 8 cm width L. Such a width is not in accordance with the FIG norms, but enables a gymnast to train under more complex conditions than those she will encounter in competition. Thus, once in competition, the performance of her exercise on the beam is facilitated. The gymnast has greater confidence and her stress is reduced.

The invention enables the passage from a beam configuration in accordance with the norms of the International Gymnastics Federation shown in FIG. 3, to a different configuration, for example that shown in FIG. 4 or in FIG. 5, simply by changing the top part 7 of the beam 2. In entirely similar manner, various configurations of the top part 7 of the beam 2 may be provided in terms of hardness of the bearing surface. These various configurations of hardness may be obtained by modifying the layer of flexible material 11 from one configuration to another. The layer of flexible material may in particular comprise a rubbery material, a foam such as a polyurethane foam as well as any other suitable flexible material, or even a multi-layer composite of such materials.

In addition to a bearing surface hardness in accordance with the FIG norms, upper parts 9 of specific cross-section elongate member that have greater flexibility may be provided. This leads the balance beam to be less liable to cause injury than a conventional beam, in particular in case of repetition of impacts (jumps, etc.) on the beam.

Of course, the diversity provided in terms of hardness may be applied to beam top parts of various widths. This for example enables a gymnastics club to select the beam top parts it considers are needed, from a wide range.

Figure 6:
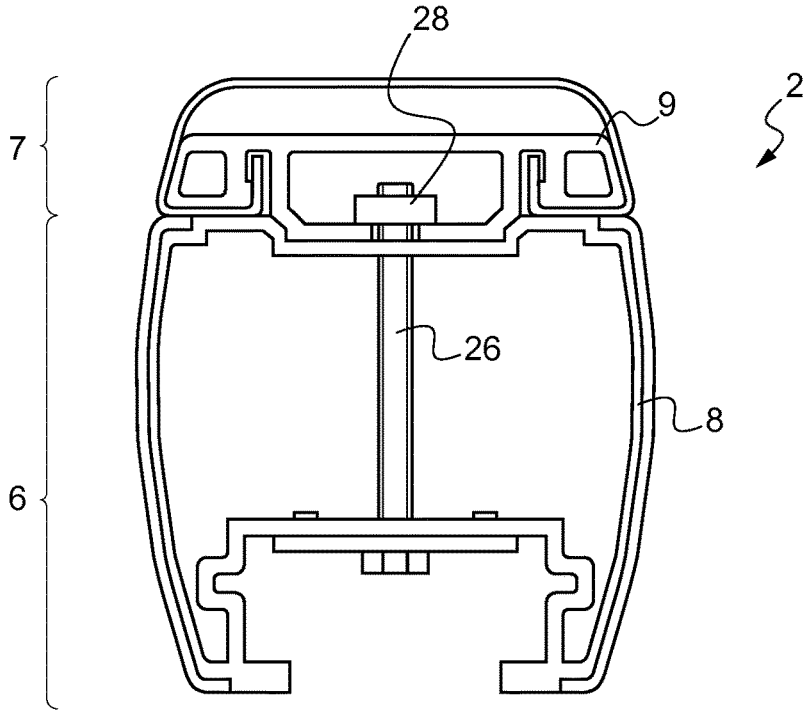
FIG. 6 show a balance beam in accordance with another embodiment of the invention, in a cross-section view.

FIG. 6 shows a balance beam in accordance with a second embodiment of the invention in a cross-section view on the section plane C-C. The balance beam 2 shown in FIG. 6 differs from the embodiment of FIG. 3 by the connecting means employed to attach or detach the top part 7 of the beam 2 from its bottom part 6.

In the example of FIG. 6, the connecting means are formed by a threaded member, here a screw 26 having a head 27 bearing on the lower part 8 of the elongate member of specific cross-section, here in the lower cavity 25. The screw 26 is engaged in a tapped member 28 rigidly connected to (or formed within) the upper part 9 of the elongate member of specific cross-section. The use of other threaded members such as a stud in place of the screw 26 may of course be envisioned without departing from the scope of the invention. More generally, the use of any mechanical connection means enabling the top part 7 of the beam 2 to be attached or detached from its bottom part may be envisioned.

Naturally, whatever the connecting means employed, several connecting means are generally employed. The connecting means are advantageously distributed along the beam 2.

Figure 7:
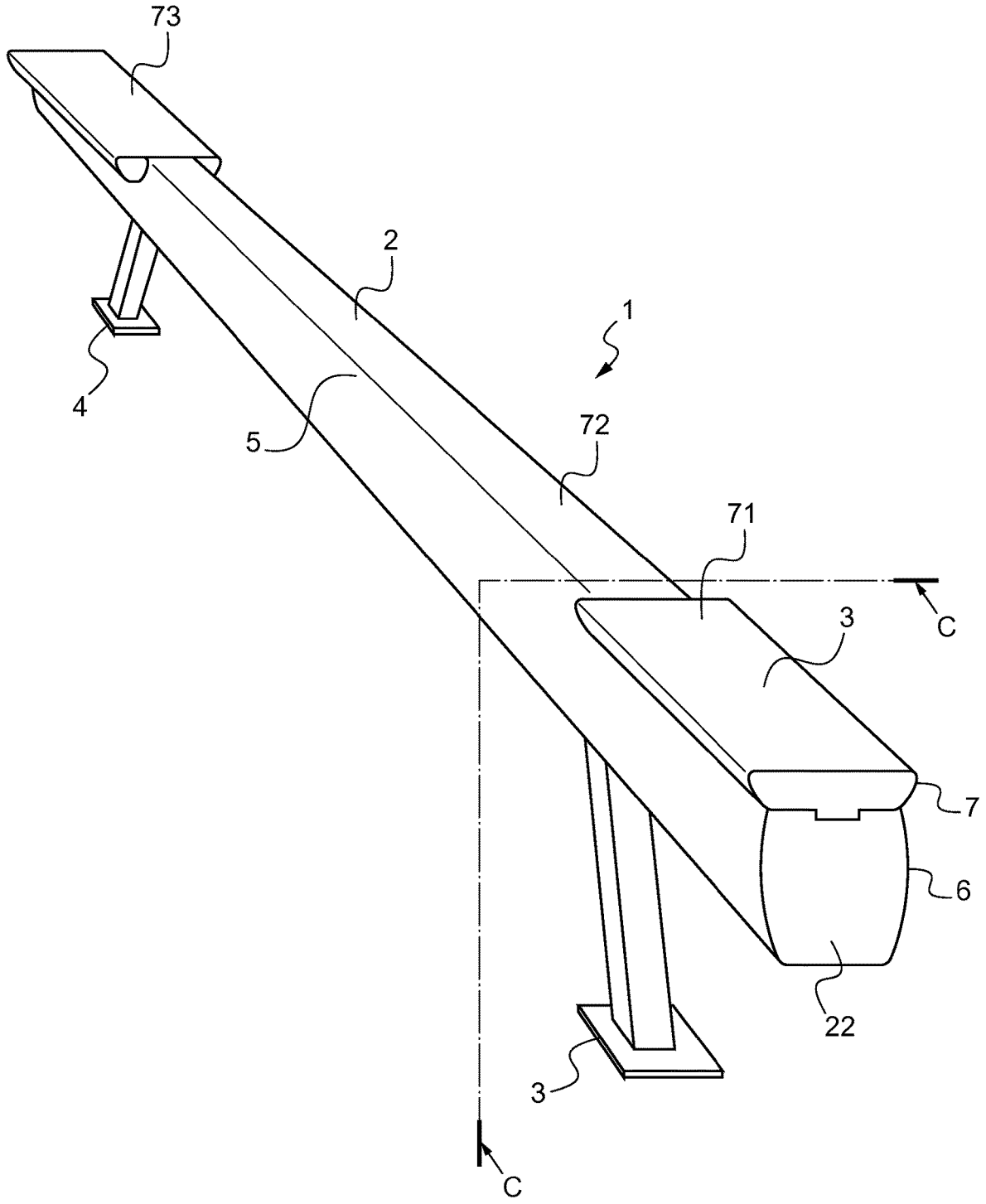
FIG. 7 shows, in a three-dimensional diagrammatic view similar to those of FIGS. 1 and 2, a gymnastics balance beam in accordance with an embodiment of the invention.

FIG. 7 shows a gymnastics balance beam in accordance with an embodiment of the invention in which the top part 7 of the beam 2 is constituted by several sections (71, 72, 73). The sections employed may be of identical length, for example one third of the total length of the beam, or of different length. Thus sum of the lengths of the sections advantageously corresponds to the total length of the beam 2. Each section (71,72,73) may have its own characteristics, in particular as regards its width or its hardness (flexibility of its bearing surface).

In the in the example shown in FIG. 7, a section of large width, for example of which the upper surface is equal to twenty centimeters, is disposed at each end of the beam. In the top part the beam thus successively has a first section 71 of large width, a second section 72 less wide having for example a width of ten centimeters according to the norm, and a third section 73 of large width. This configuration provides a balance beam which can facilitate the training of a gymnast in certain exercises thanks to two widened sections facilitating the gymnast's landing, and a central section where she can perform certain figures under norm-compliant conditions.

Naturally, any other combination of sections may envisioned to form the top part 7 of the beam.

The invention so developed enables a gymnastics balance beam to be obtained which can be easily renovated, in particular without unavailability linked to a return to a workshop for renovation. It also makes it possible to change configuration for the beam easily, in particular as regards the width of the beam and/or the hardness of its bearing surface.

The balance beam is thus modular, by changing only its top part, which is economical and easy.

The invention claimed is:

1. A gymnastics balance beam comprising:

a rigid elongate member, a layer of a flexible material disposed on an upper surface of said elongate member, a covering which covers said layer of flexible material, and a bottom part comprising a lower part of the elongate member and a top part comprising an upper part of the elongate member, the upper part being laid in a bearing relationship on the lower part, the upper part being rigidly fastened to the lower part of the elongate member by connecting means configured to attach or detach the bottom part and the top part, wherein the connecting means comprise a shaft passing vertically through the lower part of the elongate member, the shaft comprising a head at one end, the connecting means further comprising an actuating mechanism making it possible to raise or lower the shaft in the shaft's direction of extension, such that in a lowered position of the shaft, the head presses upon the upper part of the elongate member which attaches the upper part to the top part of the elongate member and holds the upper part in position.

2. The balance beam according to claim 1, wherein a lower face of the upper part of the elongate member bears on an upper face of the lower part of the elongate member with which the lower face has complementarity of shape.

3. The balance beam. according to claim 2, wherein the top part is constituted by plural separate sections, said sections differing from each other by their width and/or by the hardness of their layer of flexible material.

4. The balance beam according to claim 1, wherein the upper part comprises a longitudinal groove of a width enabling the passage of the shaft but not enabling the passage of the head of said shaft, such that in a raised position of the shaft the upper part his configured to be transiationaily moved longitudinally over the lower part of the elongate member.

5. The balance beam according to claim 1, wherein the top part is constituted by plural separate sections, said sections differing from each other by their width and/or by the hardness of their layer of flexible material.

6. An assembly comprising a balance beam according to claim 1 and at least one additional top part, said additional top part differing from the top part of the balance beam by the width of its upper surface, and/or by the hardness of the layer of flexible material that is disposed thereon.

7. The assembly according to claim 6, wherein a width of the upper surface of the top part of the balance beam is different from a width of the unner surface of the at least one additional top part of the balance beam, the width of the upper surface of the top part of the balance beam and the width of the upper surface of the at least one additional top part of the balance beam selected from among: ten centimeters, eight centimeters, twelve centimeters, fifteen centimeters, and twenty centimeters.

8. The assembly according to claim 6, wherein the upper surface of the top part of the balance beam is comprised of disposed layers of flexible material of a first hardness and the top surface of the at least one additional top part of the balance beam is comprised of disposed layers of flexible material of a second hardness, the second hardness being different from the first hardness.

9. The assembly according to claim 7, wherein the upper surface of the top part of the balance beam is comprised of disposed layers of flexible material of a first hardness and the top surface of the at least one additional top part of the balance beam is comprised of disposed layers flexible material of a second hardness, the second hardness being different from the first hardness.

10. A method of renovating a balance beam, comprising the successive steps of:

providing a balance beam according to claim 1, providing a new top part, detaching the top part of the balance beam from the bottom part of said balance beam, removing said top part of the balance beam, laying the new top part on the bottom part of the balance beam, and attaching the new top part to the bottom part of the balance beam by the connecting means.

11. An assembly comprising a balance beam according to claim 2 and at least one additional top part, said additional top part differing from the top part of the balance beam by the width of its upper surface, and/or by the hardness of the layer of flexible material that is disposed thereon.

12. A gymnastics balance beam comprising:

a rigid elongate member, a layer of a flexible material disposed on an upper surface of said elongate member, a covering which covers said layer of flexible material, and a bottom part comprising a lower part of the elongate member and a top part comprising an. upper part of the elongate member, the upper part being laid in bearing relationship on the lower part, the upper part being rigidly fastened to the lower part of the elongate member by connecting means configured to attach or detach the bottom part and the top part, wherein the connecting means comprise a. threaded. member passing through the lower part of the elongate member, said threaded member being engaged in a tapped member rigidly connected to the upper part or formed within the upper part.

13. An assembly comprising a balance beam according to claim 12 and at least one additional top part, said additional top part differing from the top part of the balance beam by the width of its upper surface, and/or by the hardness of the layer of flexible material that. is disposed thereon.

14. The balance beam according to claim 12, wherein a lower face of the upper part of the elongate member bears on an upper face of the lower part of the elongate member with which the lower face has complementarity of shape.

* * * * *